US005715875A

United States Patent [19]

Clary et al.

[11] Patent Number: 5,715,875

[45] Date of Patent: Feb. 10, 1998

[54] METHOD AND APPARATUS FOR DRY TESTING VAPOR RECOVERY SYSTEMS

[75] Inventors: Robert P. Clary, Hamilton County; Mark D. Dalhart, Warren County, both of Ohio; Chris Cusveller, GM Noordwyk, Netherlands

[73] Assignee: Dover Corporation, New York, N.Y.

[21] Appl. No.: 711,174

[22] Filed: Sep. 9, 1996

[51] Int. Cl.[6] ..... B65B 1/04

[52] U.S. Cl. ..... 141/59; 141/209; 141/217; 141/392; 141/94

[58] Field of Search ..... 141/59, 392, 206–209, 141/217, 227, 94; 251/14; 73/865.9, 23

[56] References Cited

U.S. PATENT DOCUMENTS

| | | | |
|---|---|---|---|
| 3,719,215 | 3/1973 | Murray . | |
| 3,996,979 | 12/1976 | Barr et al. . | |
| 4,138,880 | 2/1979 | Cohen et al. | 73/23 |
| 4,143,689 | 3/1979 | Conley et al. . | |
| 4,351,375 | 9/1982 | Polson . | |
| 4,491,296 | 1/1985 | Frank | 251/14 |
| 4,697,624 | 10/1987 | Bower et al. . | |
| 4,735,243 | 4/1988 | Ehlers . | |
| 5,224,525 | 7/1993 | Weichel . | |
| 5,234,036 | 8/1993 | Butkovich et al. . | |
| 5,269,353 | 12/1993 | Nanaji et al. | 141/59 |
| 5,297,594 | 3/1994 | Rabinovich . | |
| 5,316,057 | 5/1994 | Hasselmann | 141/94 |
| 5,327,944 | 7/1994 | Healy . | |
| 5,327,949 | 7/1994 | Dolson et al. . | |
| 5,363,889 | 11/1994 | Simpson et al. . | |
| 5,379,811 | 1/1995 | Dolson et al. . | |
| 5,390,712 | 2/1995 | Parrish et al. . | |
| 5,392,824 | 2/1995 | Rabinovich . | |
| 5,394,909 | 3/1995 | Mitchell et al. . | |
| 5,417,259 | 5/1995 | Schneider . | |
| 5,435,356 | 7/1995 | Rabinovich . | |
| 5,450,884 | 9/1995 | Shih et al. . | |
| 5,522,440 | 6/1996 | Mitchell . | |
| 5,592,979 | 1/1997 | Payne et al. | 141/94 |
| 5,620,031 | 4/1997 | Dalhart et al. . | |

*Primary Examiner*—Henry J. Recla
*Assistant Examiner*—Steven O. Douglas
*Attorney, Agent, or Firm*—Dinsmore & Shohl LLP

[57] ABSTRACT

A vapor recovery valve that includes two mechanisms for opening the valve is disclosed. The first mechanism opens the valve when fuel is being dispensed by a fuel delivery system. The second mechanism selectively opens the valve independent of whether the fuel delivery system is dispensing fuel. A method for dry testing a vapor recovery system is also disclosed. The method involves disabling the fuel dispensing capability of the fuel delivery system, and then operating the vapor recovery system at a rate that corresponds to a predetermined imaginary fuel dispensing rate. Next, the vapor recovery path is opened, and its operation is measured and determined if it is sufficient for the imaginary fuel delivery rate.

20 Claims, 4 Drawing Sheets

METHOD AND APPARATUS FOR DRY TESTING VAPOR RECOVERY SYSTEMS

TECHNICAL FIELD

The present invention relates generally to fuel delivery systems with vapor recovery capabilities, and will be specifically disclosed as a method and apparatus for dry testing vapor recovery systems.

BACKGROUND

Environmental and energy concerns have motivated the development of fuel vapor recovery systems. Such systems are every increasingly being used in fuel delivery systems, such as the fuel nozzles commonly used in filling stations for pumping liquid fuels (e.g. gasoline, diesel, ethanol, etc.) into vehicles. With traditional fuel nozzles that do not contain vapor recovery systems, fuel vapor escapes from the pumped liquid fuel and drifts into the atmosphere. The escaped fuel vapor harms the environment and additionally represents lost potential energy. Vapor recovery systems are intended to collect the escaping fuel vapor and recycle them back into liquid fuel.

FIG. 1 depicts a typical fuel nozzle 10 for dispensing liquid fuel, which is only a part of overall fuel delivery system. The fuel delivery path 20 in the nozzle 10 extends from a fuel inlet 21 to a fuel outlet 22 located at the end of a spout 14, which is secured to the nozzle 10. A vapor recovery path 30 extends in the opposite direction from a plurality of vapor inlet holes 31 circumferentially located around the fuel discharge end of the spout 14 to a vapor outlet 32 concentrically located around the fuel inlet 21 of the nozzle 10. When an operator pulls a handle 12, a fuel delivery valve 25 (shown symbolically in FIG. 1) opens, allowing fuel to flow through the flowpath 20 in the direction indicated by the arrows 20*a*. When fuel is being dispensed, a vapor recovery valve 40 (also shown schematically in FIG. 1) automatically opens, which allows a suction system (not shown) to draw fuel vapor escaping from the dispensed fuel into the vapor inlet holes 31, channel the vapor through the flowpath 30 in the direction indicated by the arrows 30*a*, and pump the vapor back into a fuel storage tank (not shown), which is typically located underground below the refilling station.

Periodically, fuel vapor recovery systems must be checked to insure that they operate within the system specifications. Since existing vapor recovery valves 40 open in response to the flow of fuel through the fuel delivery system, the vapor recovery system can only be tested when fuel is being dispensed. Testing is typically achieved by filling a test tank with fuel and measuring the amount of gaseous matter recovered by the vapor recovery system. The gaseous recovery (i.e. "A") is divided by the amount of liquid fuel dispensed (i.e. "L") to create a measured performance ratio range (i.e. "A/L") of the vapor recovery system. This measured ratio is compared with a predetermined performance ratio range to confirm that the system is operating within the system specifications. Due to the fact that the tester must handle dispensed fuel and eventually dispose of the fuel (frequently by pouring it back into the underground storage tank), the testing of vapor recovery systems can be time consuming, difficult and messy. Furthermore, such tests risk spillage of the liquid fuel and the escape of fuel vapor from the test samples, which can harm the environment and result in lost energy, thus defeating the very purpose of vapor recovery systems.

SUMMARY OF THE INVENTION

Accordingly, an object of this invention is to provide an improved valve for vapor recovery systems.

An additional object of this invention is to provide a vapor recovery valve that can be opened independent of fuel being dispensed by the fuel delivery system.

A further object of the invention is to provide a vapor recovery valve that opens when fuel is being dispensed by the fuel delivery system, and can be opened independent of whether fuel is being dispensed.

Still a further object of this invention is to provide an improved method for testing vapor recovery systems.

Yet another object of this invention is to provide a method for testing vapor recovery systems without having to dispense fuel.

Additional objects, advantages, and novel features of the invention will be set forth in part in the description that follows and in part will become apparent to those skilled in the art upon examining or practicing the invention. The objects and advantages of the invention may be realized and obtained by means of the instrumentalities and combinations particularly pointed out in the appended claims.

One embodiment of the present invention is an apparatus for controlling the flow of fuel vapor in a vapor recovery system. The apparatus has a valve body with a fluid passage extending between an inlet and an outlet, with the fluid passage defining a portion of a vapor recovery path. A valve member for controlling the flow of fuel vapor is disposed in the fluid passage. The valve member can move relative to the valve body between an opened and a closed position. In the opened position fuel vapor can flow through the vapor recovery path, and in the closed position fuel vapor is prevented from flowing. One embodiment of the invention has two mechanisms for moving the valve member to its opened position. The first mechanism operates when fuel is being dispensed by the fuel delivery system, preferably by moving the valve member to its opened position in response to fuel flowing through the fuel delivery system. The second mechanism is for selectively moving the valve member to its opened position independent of whether fuel is being dispensed by the fuel delivery system. A biasing mechanism, such as a spring, is used for urging the valve member to its closed position.

Another aspect of the present invention is a method for dry testing a vapor recovery system. The first step in this method involves disabling the fuel dispensing capability of the fuel delivery system. Next, the vapor recovery system is operated at a rate that corresponds to a predetermined imaginary fuel dispensing rate. The vapor recovery path is then opened, preferably by activating the second mechanism, while the fuel dispensing capability remains disabled. Lastly, the operation of the vapor recovery system is measured and compared with the system specifications to determine if the measured operation of the vapor recovery system is sufficient for the predetermined imaginary fuel delivery rate.

Still other aspects of the present invention will become apparent to those skilled in the art from the following description of a preferred embodiment, which is simply by way of illustration one of the best modes contemplated for carrying out the invention. As will be realized, the invention is capable of other different obvious aspects all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and together with their description serve to explain the principles of the invention. In the drawings.

Reference will now be made in detail to the present preferred embodiment of the invention, an example of which is illustrated in the accompanying drawings, wherein like numerals indicate the same elements throughout the views.

DETAILED DESCRIPTION OF THE PREFERRED EMBODIMENT

Figure 1:
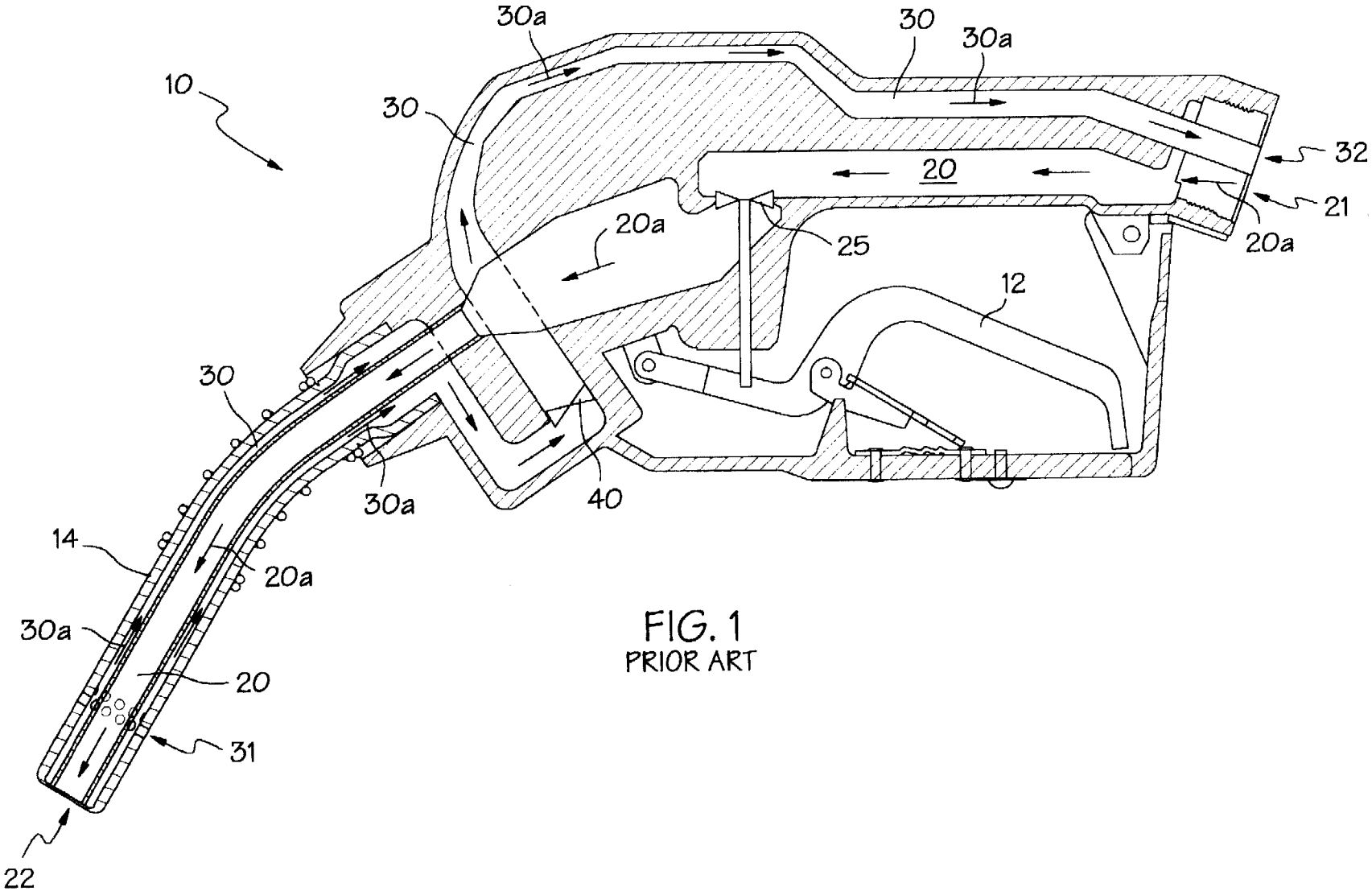
FIG. 1 PRIOR ART
FIG. 1 shows a prior art fuel nozzle, which is part of a larger fuel delivery system, that includes a portion of a vapor recovery system.

Vapor recovery systems are often incorporated into fuel delivery systems to recover fuel vapor escaping from liquid fuel as it is being dispensed. As shown in FIG. 1, the fuel nozzle 10, which forms part of a fuel delivery system, has a fuel delivery path 20 controlled by the fuel delivery valve 25, and a vapor recovery path 30 controlled by the vapor recovery valve 40. Typically, the vapor recovery system uses a suction type mechanism (not shown) to draw escaping vapor into the inlet 31, through the vapor recovery path 30, and to the exit 32, where the recovered fuel vapor is recycled back into liquid fuel. In most fuel delivery systems, the vapor recovery valve 40 opens, thereby operating the vapor recovery system, only when fuel is being dispensed by the fuel delivery system. For instance, one such valve 40 includes an expandable diaphragm with one side exposed to the fuel delivery path 20 and the other to the valve 40, whereby when pressurized fuel is flowing through the path 20, the diaphragm expands and moves the valve 40 to its opened position.

Since existing vapor recovery valves only open when fuel is being dispensed by the fuel delivery system 10, the vapor recovery system can only be tested when fuel is being dispensed. As a result, the testing of vapor recovery systems can be time consuming, difficult and messy due to the fact that the tester must handle dispensed fuel and eventually dispose of the fuel. Furthermore, such tests risk spillage of the liquid fuel and the escape of the fuel vapor from the test samples, which can harm the environment and result in lost energy, thus defeating the very purpose of fuel vapor recovery systems. The present invention facilitates the testing of vapor recovery systems without dispensing fuel.

Figure 2:
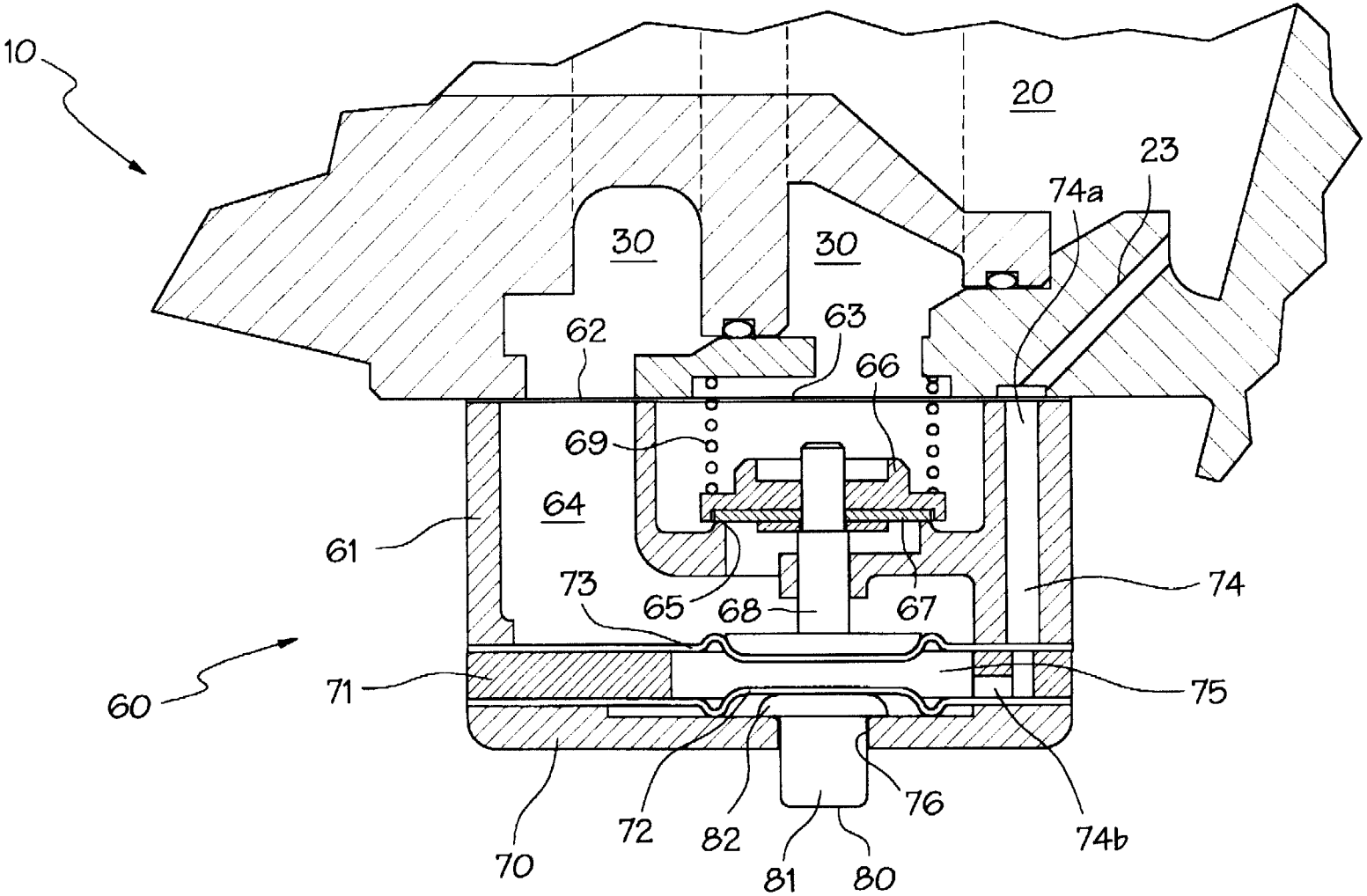
FIG. 2 shows a cross-section of a vapor recovery valve attached to a fuel nozzle that will open when fuel is being dispensed by the fuel delivery system, which can be selectively opened independent of whether fuel is being dispensed by the fuel delivery system.

One embodiment of the present invention is the valve 60 depicted in FIG. 2. The valve 60 is mounted to a fuel nozzle 10, which is substantially similar to the nozzle 10 in FIG. 1, to control the flow of fuel vapor through the vapor recovery path 30. While this embodiment is mounted to the nozzle 10, the valve 60 could be located elsewhere in the fuel delivery system, anywhere along the vapor recovery path 30. The valve body 61 has a fluid passage 64 extending between the inlet 62 and the outlet 63, which defines a portion of the vapor recovery path 30. The valve 60 includes a movable valve member 66 having an opened position and a closed position. In the opened position, fluid communication exists between the inlet 62 and the outlet 63, such that fuel vapor can flow through the vapor recovery path 30. In the closed position, as shown in FIG. 2, the valve member 66 blocks the fluid passage 64 such that fuel vapor is substantially prevented from flowing through the vapor recovery path 30. To encourage a vapor-tight interface, a seal 67 is interposed between the seat 65 and the valve member 66. The valve 60 also includes a biasing mechanism 69 that urges the valve member 66 to its closed position. Here, the biasing mechanism 69 is a spring, however, many other mechanisms such as gravity or a vacuum could also be used to urge the valve 60 to its closed position. The valve 60 is enclosed by an intermediate plate 71 and a valve cap 70, which can be attached to the body 61 using a variety of means, including screws, snap-fits, welds, etc. The diaphragms 72, 73 act as seals between the three components 61, 70, and 71.

The valve 60 has a first activation mechanism for moving the valve member 66 to its opened position when fuel is being dispensed by the fuel delivery system. In this embodiment, the valve member 66 moves in response to the flow of fuel through the fuel delivery path 20. The valve body 61 and the intermediate plate 71 define a fuel passage 74 between an inlet **74*a*, which is connected to the fuel delivery path 20 through the bleed line 23, and an outlet 74*b*, which is connected to an expansion chamber 75. When pressurized fuel is introduced to the fuel delivery path 20, preferably due to the opening of the fuel delivery valve 25, the fuel will flow into the fuel passage 74 and pressurize the expansion chamber 75. Once pressurized, the diaphragm 73, which is preferably formed from an elastomeric material, expands and imparts a load on a valve stem 68, which is connected to the valve member 66. When the load from the diaphragm 73 exceeds the load from the biasing mechanism 69, the valve member 66 will move relative to the body 61 and away from the seat 65, thereby opening the valve 60. In the opened position, fuel vapor can readily flow through the vapor recovery path 30. As the fuel pressure in the fuel delivery path 20 decreases, which preferably occurs when the fuel delivery valve 25 is closed, the pressure in the chamber 75 drops, causing a drop in the load imparted by the diaphragm 73. When the load from the diaphragm 73 becomes less than the load from the biasing mechanism 69, the valve member 66 returns to its closed position. In the closed position, fuel vapor is substantially prevented from flowing through the vapor recovery path 30**.

Beyond the first actuation mechanism depicted in FIG. 2, which responds to pressurized fuel in the flowpath 20, many alternative mechanisms could readily be used. For instance, the valve member 66 could be moved to its opened position by the suction created from a venturi in the fuel delivery path 20. Alternatively, the valve 60 could be mechanically linked with the handle 12, directly or through the fuel delivery valve 25, such that the valve 60 opens when the handle 12 is actuated. Beyond these examples, a variety of other suitable configurations could be employed to open the valve 60 when fuel is being dispensed.

The valve 60 also includes a second activation mechanism for selectively moving the valve member 66 to its opened position independent of whether fuel is being dispensed. A button shaft 81 extends through a hole 76 in the valve cap 70, and is in substantial alignment with the valve stem 68. Since the shaft 81 and the hole 76 are not in sealing contact, a diaphragm 72, preferably formed from an elastomeric material, is provided to prevent leakage of fuel from the expansion chamber 75 to the external environment. A button head 82, which is larger than the hole 76, prevents the button 80 from liberating itself from the valve 60. When the button 80 is initially depressed (i.e. displaced in the direction towards the top of FIG. 2), it pushes the two diaphragms 72, 73 together between the head 82 and the stem 68. As the button 80 is depressed further, its movement is transmitted through the diaphragms 72, 73 and the stem 68 to the valve member 66, which will cause the valve member 66 to lift away from the seat 65, thereby opening the valve 60. When the button 80 is released, the biasing mechanism 69 will urge the valve member 66 back to its closed position. Here, the second activation mechanism is operated by pushing the button 80, but many alternative embodiments could readily be implemented, such as a pull button, a switch, a nob, etc. While this embodiment of the second activation mechanism is manually operated, the mechanism could also be automatically or remotely operated.

An alternative embodiment of the second activation mechanism for the valve 60 is illustrated in FIG. 3. While this embodiment shares many of the same components as the valve 60, one difference lies in the valve cap 96 (best seen in FIG. 3*a*), which includes a raised boss 98 with a specially shaped key hole 97. As shown in FIG. 3*b*, the second activation mechanism is in its sealed position. A screw 94 is inserted through the hole 97 that threadedly engages a push core 93. When the screw 94 is tightened, the push core 93 is pulled downward and secured against the cap 96. The load from the tightened screw 94 compresses a gasket 95 to provide a seal between the screw 94 and the boss 98, thereby sealing the expansion chamber 75. Since the gasket 95 provides a seal between the expansion chamber 75 and the outside environment, the diaphragm 72 in the valve 60 could be exchanged with a gasket to seal between the cap 96 and the intermediate plate 71.

Figure 3D:
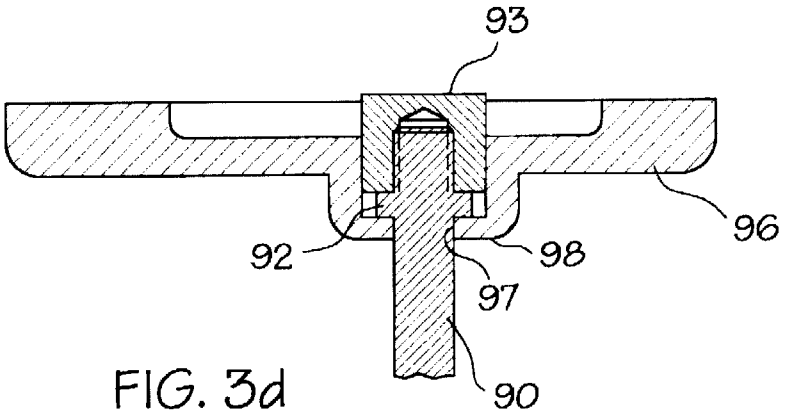
FIG. 3*d* shows a cross-sectional view of the opening mechanism of FIG. 3*a* with the key inserted therein.
Figure 3A:
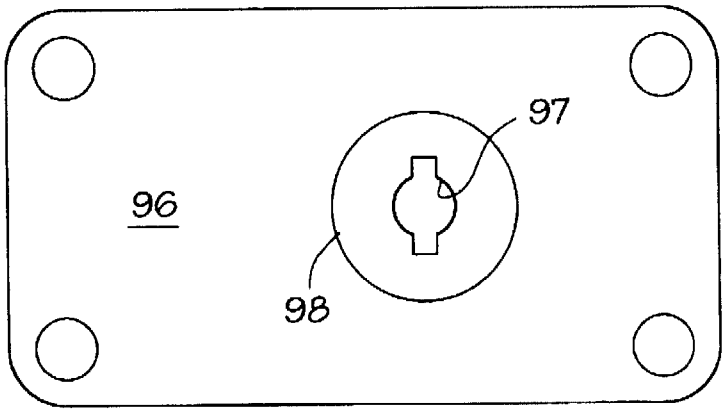
FIG. 3*a* shows the valve cap of a mechanism for selectively opening a vapor recovery valve independent of whether fuel is being dispensed by the fuel delivery system.
Figure 3B:
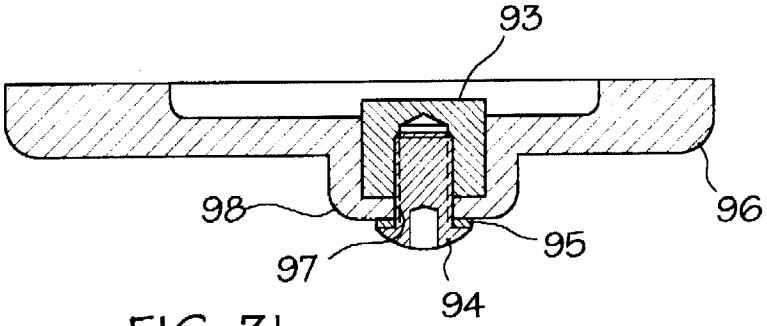
FIG. 3*b* shows a cross-sectional view of the opening mechanism of FIG. 3*a* in its sealed position.
Figure 3C:
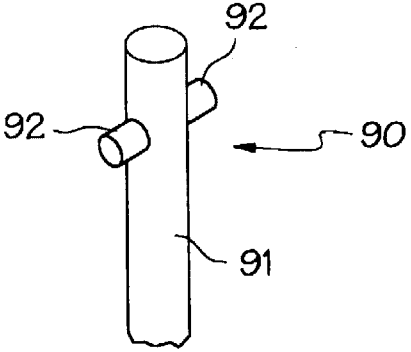
FIG. 3*c* shows a key adapted for operating the opening mechanism of FIG. 3*a;*

This embodiment of the second activation mechanism is intended to be operated by a key 90 as depicted in FIG. 3*c*. The key 90 has two teeth 92 that extend perpendicularly from the axis of the shaft 91, which are designed to fit through the specially shaped hole 97. As shown in FIG. 3*d*, after the screw 94 has been removed, and when the key 90 is inserted into the hole 97 and rotated 90 degrees, the teeth 92 catch on the inner surface of the boss 98, thereby preventing the key 90 from being removed from the hole 97. When inserted, the tip of the key 90 displaces the push core 93 in an upward direction, which will move the valve member 66 to its opened position. One advantage of the key embodiment depicted in FIG. 3 is that the valve 60 will remain open until the key is removed, whereas the button embodiment of FIG. 2 requires constant external pressure on the button 80 for the valve 60 to remain open.

A possible variation of the embodiment of FIG. 3 is to use the screw 94 as the mechanism to open the valve 60. This could be achieved by loosening the screw 94, but not to the point of liberating it from the push core 93, which would jack the push core 93 upwards to displace the valve member 66 to its opened position. Preferably, the screw 94 would be axially fixed in the valve cap 96.

Figure 4:
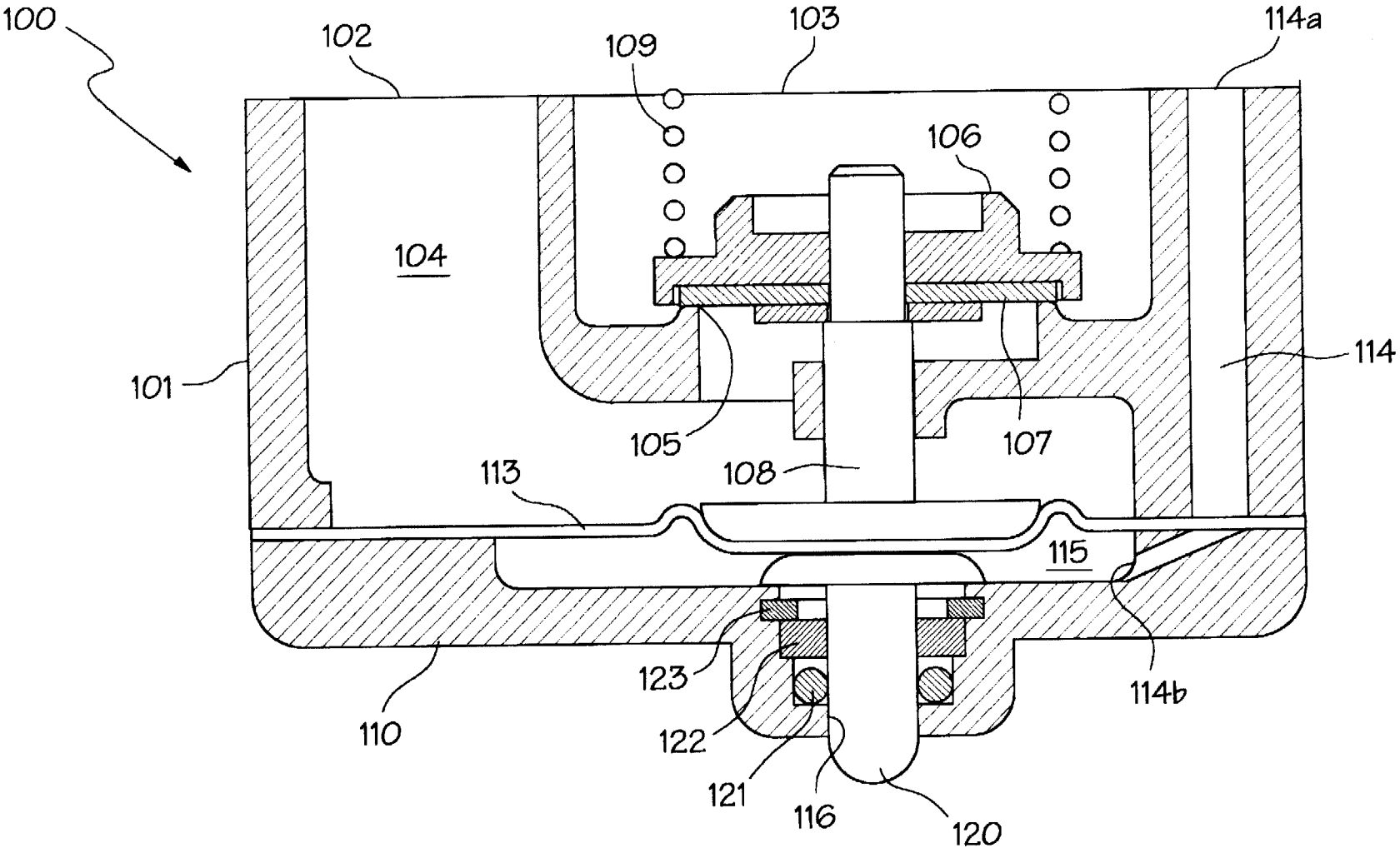
FIG. 4 illustrates a cross-section of a vapor recovery valve that will open when fuel is being dispensed by the fuel delivery system, which can be selectively opened independent of whether fuel is being dispensed by the fuel delivery system.

Another embodiment of the invention is the valve 100 shown in FIG. 4, which could be readily substituted for the valve 60 on the nozzle 10. The valve body 101 has a fluid passage 104 extending between the inlet 102 and outlet 103, which defines a portion of the vapor recovery path 30. This valve 100 includes a movable valve member 106 having an opened position and a closed position. To encourage a vapor-tight interface, a seal 107 is interposed between the seat 105 and the valve member 106. A biasing mechanism 109 urges the valve member 106 to its closed position. The valve 100 is contained by a valve cap 110, which is sealed against the body 101 by a diaphragm 113.

This valve 100 includes a first activation mechanism that will open the valve 100 when fuel is being dispensed by the fuel delivery system 10. The valve body 101 and the valve cap 110 define a fuel passage 114 with the inlet 114*a* being connected to the fuel delivery path 20, preferably through the bleed line 23, and the outlet 114*b* connected to the expansion chamber 115. In response to pressurized fuel flowing through the fuel delivery path 20, the expansion chamber 115 will become pressurized, which will cause the diaphragm 113 to expand. The motion of the diaphragm 113 will be transmitted through the stem 108 to the valve member 106, thus moving it to its opened position.

This valve 100 also has a second activation mechanism for moving the valve member 106 to its opened position independent of whether fuel is being dispensed. A button 120 extends through a hole 116, which is sealed by an o-ring 121 that provides a constant seal between the cap 110 and the button 120 even when the button 120 is moving, thus eliminating the need for the diaphragm 72 in the valve 60. A washer 122 and a retainer 123 contain the o-ring 121 in its position. Since the cap 110 defines a portion of the fuel passage 114, the need for the intermediate plate 71 in the valve 60 is also eliminated. When the button 120 is depressed, its movement is transmitted through the diaphragm 113 and the stem 108 to the valve member 106, which will lift the valve member 106 off the seat 105, thereby opening the valve 100. When the button 120 is released, the biasing mechanism 109 will urge the valve member 106 back to its closed position.

Another aspect of the present invention is a method for dry testing (i.e. not dispensing fuel) a vapor recovery system. The first steps of the method involves disabling the fuel dispensing capability of the fuel delivery system 10. The second step involves operating the vapor recovery system at a rate that corresponds to a predetermined imaginary fuel dispensing rate. Often, vapor recovery systems operate at a rate proportional to the fuel delivery rate. Disabling the fuel dispensing capability will trick the vapor recovery system to operate at its proportional rate while preventing fuel from being dispensed. In those systems where the vapor recovery system operates independent of the fuel delivery system, the step of disabling can be achieved by simply activating the vapor recovery system while not activating the fuel delivery system, such as by not actuating the fuel delivery handle 12.

The next step involves opening the vapor recovery path 30 while the fuel dispensing capability of the fuel delivery system 10 is disabled. Since the fuel dispensing capability will have been disabled, no fuel will be dispensed and the vapor recovery system will be recovering air (instead of fuel vapor) through the flowpath 30. This step can be achieved manually, such as by using one of the secondary activation mechanisms illustrated in FIGS. 2–4, or automatically. The vapor recovery system could include one or more mechanisms for opening the vapor recovery path 30. For instance, the valves 60, 100 each included two mechanisms for opening the valve: one mechanism operates when fuel is flowing through the fuel delivery path 20, and the other mechanism operates independent of the flow of fuel. Beyond these embodiments, other suitable vapor recovery valves could be used for opening the vapor recovery path 30, such as a vapor recovery valve mechanically linked with the handle 12, whereby when an operator pulls the handle 12 the vapor recovery valve opens.

Next, the operation of the vapor recovery system is measured. Preferably, this step is achieved by measuring the rate of gaseous recovery by the vapor recovery system, which one with ordinary skill in the art will readily appreciate can be achieve in a variety of ways, such as by measuring mass, volume, pressure, time, flowrate, etc. The last step involves determining if the measured operation of the vapor recovery system is sufficient for the imaginary fuel delivery rate. While a variety a methods may be used to determine sufficiency, this last step is preferably achieved by dividing the rate of gaseous recovery ("A") of the vapor recovery system by the imaginary fuel dispensing rate ("L"), and comparing the calculated ratio ("A/L") with a predetermined performance ratio range. A calculated ratio within the performance ratio range indicates that the vapor recovery system operates within the system specifications. On the other hand, a measured ratio outside the performance ratio range indicates that the vapor recovery system may be operating outside the system specifications.

The foregoing description of the preferred embodiment of the invention has been presented for purposes of illustration and description. It is not intended to be exhaustive nor to limit the invention to the precise form disclosed. Many alternatives, modifications and variations will be apparent to those skilled in the art in light of the above teaching. Accordingly, this invention is intended to embrace all such alternatives, modifications and variations that fall within the spirit and broad scope of the appended claims.

We claim:

1. An apparatus for controlling the flow of recovered fuel vapor in a fuel delivery system, comprising:

a) a valve body, said valve body having an inlet, and outlet, and a fluid passage extending between the inlet and outlet, said fluid passage defining a portion of a vapor recovery path;

b) a valve member movably disposed relative to the valve body for controlling the flow of fuel vapor through the vapor recovery path, said valve member having:

an opened position whereby the inlet and outlet are in fluid communication, and ii. a closed position whereby the inlet and outlet are substantially out of fluid communication;

c) a biasing mechanism for biasing the valve member to its closed position;

d) a first activation mechanism for moving the valve member to its opened position when fuel is being dispensed by the fuel delivery system; and e) a second activation mechanism for selectively moving the valve member to its opened position independent of whether fuel is being dispensed by the fuel delivery system.

2. An apparatus as recited in claim 1, wherein the biasing mechanism is a spring.

3. An apparatus as recited in claim 1, wherein the second activation mechanism is manually operated.

4. An apparatus as recited in claim 3, wherein the second activation mechanism is operated by pushing or pulling a button.

5. An apparatus as recited in claim 3, wherein the second activation mechanism is operated by turning a key.

6. An apparatus as recited in claim 3, wherein the second activation mechanism is operated by turning a screw.

7. An apparatus as recited in claim 1, wherein the first activation system moves the valve member to its opened position in response to the flow of fuel through the fuel delivery system.

8. An apparatus as recited in claim 7, wherein the first activation mechanism moves the valve member to its opened position in response to pressure from fuel in the fuel delivery system.

9. An apparatus as recited in claim 8, further comprising a diaphragm that moves in response to pressure from fuel, and a valve stem connected to the valve member for transmitting motion from the diaphragm to the valve member.

10. An apparatus as recited in claim 9, wherein the second activation mechanism is a manually operable push button and the diaphragm is interposed between the valve stem and the push button, whereby movement of the push button is transmitted through the diaphragm to the stem, thereby moving the valve member its opened position.

11. An apparatus for controlling the flow of recovered fuel vapor in a fuel nozzle, comprising:

a) a vapor recovery path for channeling fuel vapor recovered from fuel dispensed from the fuel nozzle;

b) a valve disposed in the vapor recovery path for controlling the flow of fuel vapor through the vapor recovery path, said valve having:

i. an opened position whereby the fuel vapor can flow through the vapor recovery path, and ii. a closed position whereby the fuel vapor is substantially prevented from flowing through the vapor recovery path;

c) a biasing mechanism for biasing the valve to its closed position;

d) a first activation mechanism for moving the valve to its opened position in response to the flow of fuel through the fuel nozzle; and e) a second activation mechanism for selectively moving the valve to its opened position independent of the flow of fuel through the fuel nozzle.

12. An apparatus as recited in claim 11, wherein the second activation mechanism is manually operated.

13. An apparatus as recited in claim 12, wherein the second activation mechanism is operated by pushing or pulling a button.

14. An apparatus as recited in claim 12, wherein the second activation mechanism is operated by turning a key.

15. An apparatus as recited in claim 12, wherein the second activation mechanism is operated by turning a screw.

16. An apparatus as recited in claim 11, wherein the first activation mechanism includes a diaphragm that moves in response to pressure from fuel in the fuel nozzle for moving the valve to its opened position.

17. A method for dry testing a vapor recovery system in a fuel delivery system, said vapor recovery system including a normally closed vapor recovery path for recovering fuel vapor from fuel that has been dispensed through the fuel delivery system in which said vapor recovery path opens when fuel is being dispensed by the fuel delivery system, comprising the steps of:

a) disabling the fuel dispensing capability of the fuel delivery system;

b) operating the vapor recovery system at a rate that corresponds to a predetermined imaginary fuel dispensing rate while the fuel dispensing capability of the fuel delivery system is disabled;

c) opening the vapor recovery path while the fuel dispensing capability of the fuel delivery system is disabled;

d) measuring the operation of the vapor recovery system; and e) determining if the measured operation of the vapor recovery system is sufficient for the predetermined imaginary fuel delivery rate.

18. A method as recited in claim 17, wherein the step of determining involves calculating the ratio of the measured rate of gaseous recovery of the vapor recovery system to the imaginary fuel dispensing rate, and comparing the calculated ratio with a predetermined performance ratio.

19. A method as recited in claim 17, wherein the step of opening the vapor recovery path is a manual operation.

20. A method as recited in claim 17, wherein the fuel vapor recovery system includes one or more mechanisms for opening the vapor recovery path.

* * * * *